US006871042B2

(12) United States Patent
Nemura et al.

(10) Patent No.: US 6,871,042 B2
(45) Date of Patent: Mar. 22, 2005

(54) SHEET-THICKNESS DETECTOR DEVICE AND SHEET-PROCESSING APPARATUS, IMAGE-FORMING APPARATUS HAVING THE SAME

(75) Inventors: Masaharu Nemura, Ibaraki (JP); Norifumi Miyake, Chiba (JP); Takayuki Fujii, Tokyo (JP); Tsuyoshi Moriyama, Ibaraki (JP); Yuzo Matsumoto, Ibaraki (JP); Yusuke Obuchi, Chiba (JP); Kouji Shimizu, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/463,430

(22) Filed: Jun. 18, 2003

(65) Prior Publication Data

US 2003/0235448 A1 Dec. 25, 2003

(30) Foreign Application Priority Data

Jun. 21, 2002 (JP) ..... 2002-180662

(51) Int. Cl.[7] ..... G03G 15/00

(52) U.S. Cl. ..... 399/389; 399/45; 400/56; 271/263; 271/265.04; 324/230

(58) Field of Search ..... 400/56, 708, 708.1; 399/45, 388, 389; 271/258.01, 262, 263, 265.01, 265.04; 324/207.2, 207.21, 207.22, 207.26, 229, 230

(56) References Cited

U.S. PATENT DOCUMENTS

| | | | | |
|---|---|---|---|---|
| 4,174,908 A | * | 11/1979 | Wehler | 400/56 |
| 5,042,793 A | | 8/1991 | Miyake | 271/293 |
| 5,225,852 A | | 7/1993 | Uchida et al. | 346/134 |
| 5,274,399 A | | 12/1993 | Uchida et al. | 346/134 |
| 5,293,118 A | * | 3/1994 | Grossmann et al. | 324/229 |
| 5,299,795 A | | 4/1994 | Miyake | 271/9 |
| 5,303,912 A | * | 4/1994 | Blank et al. | 271/263 |
| 5,390,016 A | | 2/1995 | Hoshi et al. | 355/308 |
| 5,455,667 A | | 10/1995 | Hiroi et al. | 355/309 |
| 5,580,039 A | | 12/1996 | Takehara et al. | 270/58.11 |
| 5,662,324 A | * | 9/1997 | Cannaverde et al. | 271/263 |
| 5,966,559 A | * | 10/1999 | May et al. | 399/45 |
| 6,203,003 B1 | | 3/2001 | Sato et al. | 271/3.01 |
| 6,219,503 B1 | | 4/2001 | Miyake et al. | 399/85 |
| 6,278,270 B1 | * | 8/2001 | Robles-Flores et al. | 324/207.21 |
| 6,330,422 B1 | | 12/2001 | Sato et al. | 399/382 |
| 6,353,726 B1 | | 3/2002 | Murata et al. | 399/407 |
| 6,371,472 B1 | | 4/2002 | Miyake et al. | 270/58.14 |
| 6,386,080 B1 | | 5/2002 | Okamoto et al. | 83/73 |
| 6,471,429 B1 | | 10/2002 | Isobe et al. | 400/582 |
| 6,505,017 B2 | | 1/2003 | Fujii et al. | 399/82 |
| 6,517,065 B2 | | 2/2003 | Miyake et al. | 270/58.09 |
| 6,603,951 B2 | | 8/2003 | Sato et al. | 399/382 |
| 2002/0127037 A1 | | 9/2002 | Fujii | 399/371 |

FOREIGN PATENT DOCUMENTS

| | | | | |
|---|---|---|---|---|
| JP | 05301657 A | * | 11/1993 | B65H/7/12 |
| JP | 2000-146510 | | 5/2000 | |

* cited by examiner

*Primary Examiner*—Ren Yan
(74) *Attorney, Agent, or Firm*—Fitzpatrick, Cella, Harper & Scinto

(57) ABSTRACT

A sheet-thickness detector device has a sheet guide with a sheet-guide surface for guiding a sheet between a magnetic field sensor and a magnetic guide element. The magnetic field sensor, having an approach-guide plane disposed upstream in a sheet conveying direction for guiding the sheet to a detection surface, comes into direct contact with the sheet. By the structure mentioned above, the thickness of a sheet is detected so as to determine sheet double feeding and the like without producing sheet jamming.

22 Claims, 11 Drawing Sheets

SHEET-THICKNESS DETECTOR DEVICE AND SHEET-PROCESSING APPARATUS, IMAGE-FORMING APPARATUS HAVING THE SAME

BACKGROUND OF THE INVENTION

1. Field of the Invention

The present invention relates to a sheet-thickness detector device for detecting the thickness of a conveyed sheet and a sheet-processing apparatus, an image-forming apparatus having the sheet-thickness detector device.

2. Description of the Related Art

An image-forming apparatus for forming images on a sheet, such as a copying machine, a facsimile machine, a printer, and a multifunction machine combining these functions may have been provided with a sheet-processing apparatus (finisher) in an apparatus body as one of its components.

In the sheet-processing apparatus, after sheets discharged from a recording unit for recording images on a sheet of an image-forming apparatus are received and stacked in a bundle, at least one of processes of lateral arrangement by jogging the bundle, punching to perforate the sheets, stapling to bind the sheets, and folding to fold the sheets is performed on the sheets.

Recently, the sheet-processing apparatus frequently includes a sheet-inserting device called as an inserter or interposer. The sheet-inserting device functions to insert an insert-sheet prepared in advance, such as a cover and an insert sheet, onto a predetermined page of the recorded sheet bundle, such as the top page, the last page, or a middle page.

In particular, one such interposer which is becoming widely used is one, in which insert-sheets prepared in advance are inserted onto one place or a plurality of places of a sheet bundle. The interposer provides for implementation of a monochrome/color mixed document at high speed and low cost when the interposer is attached to a recording unit for recording monochrome images on a sheet so as to insert color pages at mid-points of the sheet bundle.

In such an interposer, insert sheets stacked in a bundle in the inserting order by an operator are sequentially supplied at the predetermined timing and allowed to be inserted between sheets discharged from the recording unit, so that a desired sheet bundle can be prepared by the sheet-processing apparatus.

In the interposer, however, during the supplying of insert-sheets from a bundle prepared in advance, if two or more sheets are supplied at a time, i.e., so-called double feeding, a problem arises that the insert-sheets get out of order thereafter, so that after the double feeding, the sheet bundle is not a usable sheet bundle. Moreover, if the stable processing or the punching in the sheet-processing apparatus is performed on the sheet bundle, the sheet bundle cannot be reused so that it must be discarded.

Then, a conventional interposer has been provided with a sheet-thickness detector device for preventing the double feeding of the insert sheet. The sheet-thickness detector device measures the thickness of an insert sheet with a magnetic element and a magnetic field sensor and analyzes the result to determine if it is double fed. The sheet-thickness detector device of this system is widely used because it is small in size and low in cost. An example of this system is disclosed in Japanese Patent Laid-Open No. 2000-146510.

FIG. 11 shows a skeletal structure of the sheet-thickness detector device disclosed in the above publication. In a sheet-thickness detector device 11, an insert sheet P conveyed on a guide plate 13 by a feed roller 12 is pulled through between a magnetic field sensor 14 and a magnetic element 16 urged by a spring 15 toward the magnetic field sensor 14, so that the sheet thickness is detected by detecting changes in magnetism with the magnetic field sensor 14.

Incidentally, in the conventional sheet-thickness detector device 11, the magnetic field sensor 14 is provided on the bottom of the guide plate 13, so that the guide plate 13 exists between the magnetic field sensor 14 and the magnetic element 16. Therefore, in the conventional sheet-thickness detector device 11, the space between the magnetic field sensor 14 and the magnetic element 16 is increased by the thickness of the guide plate 13, correspondingly reducing accuracies in sheet-thickness detection. Also, as the guide plate 13 of the conventional sheet-thickness detector device 11, a material with high permeability has to be used; the material of the guide plate 13 is limited.

SUMMARY OF THE INVENTION

It is an object of the present invention to provide a sheet-thickness detector device capable of precisely detecting and determining sheet double-feeding and if the sheet thickness is desired.

In order to achieve the above object, a sheet-thickness detector device according to the present invention comprises a sheet-guide member having a sheet-guide surface for guiding a sheet; a fixed magnetic field sensor that directly comes into contact with a sheet guided by the sheet-guide surface; and a magnetic guide element that is urged toward the magnetic field sensor, wherein the thickness of a sheet is detected by allowing the sheet guided with the sheet-guide surface to pass through between the magnetic field sensor and the guide member, and wherein the magnetic field sensor comprises an approach-guide plane disposed upstream of a sheet-conveying direction for guiding a sheet to a portion for clamping the sheet with the guide member and the magnetic field sensor therebetween.

Further objects, features and advantages of the present invention will become apparent from the following description of the preferred embodiments with reference to the attached drawings.

DESCRIPTION OF THE PREFERRED EMBODIMENTS

A sheet-thickness detector device and a sheet-processing apparatus/copying machine as an example of an image-forming apparatus having the sheet-thickness detector device according to an embodiment of the present invention will be described with reference to the drawings.

Figure 1:
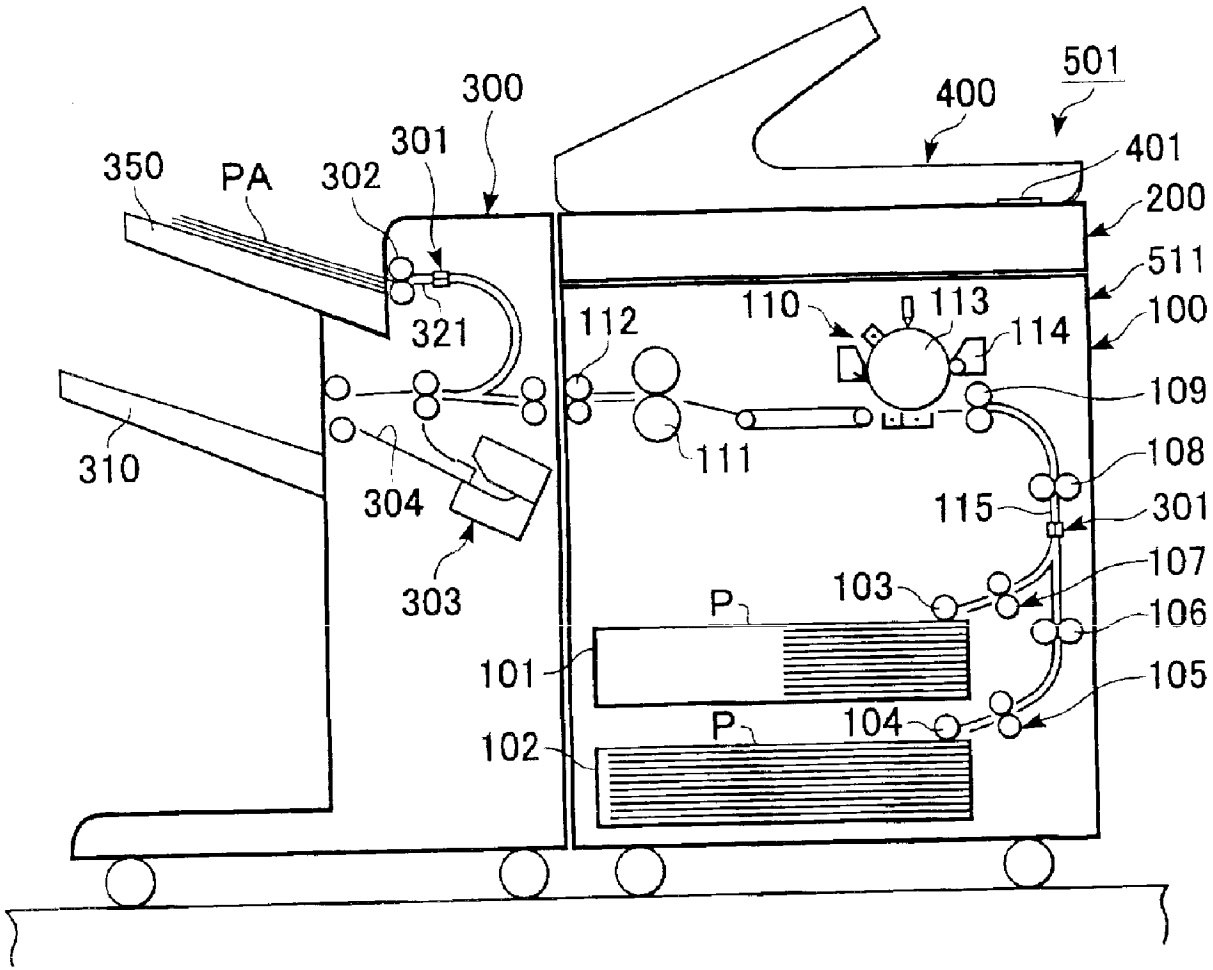
FIG. 1 is a sectional view of a copying machine having a sheet-thickness detector device according to an embodiment of the present invention both in a machine body and a sheet-processing apparatus of the copying machine, respectively.
Figure 9:
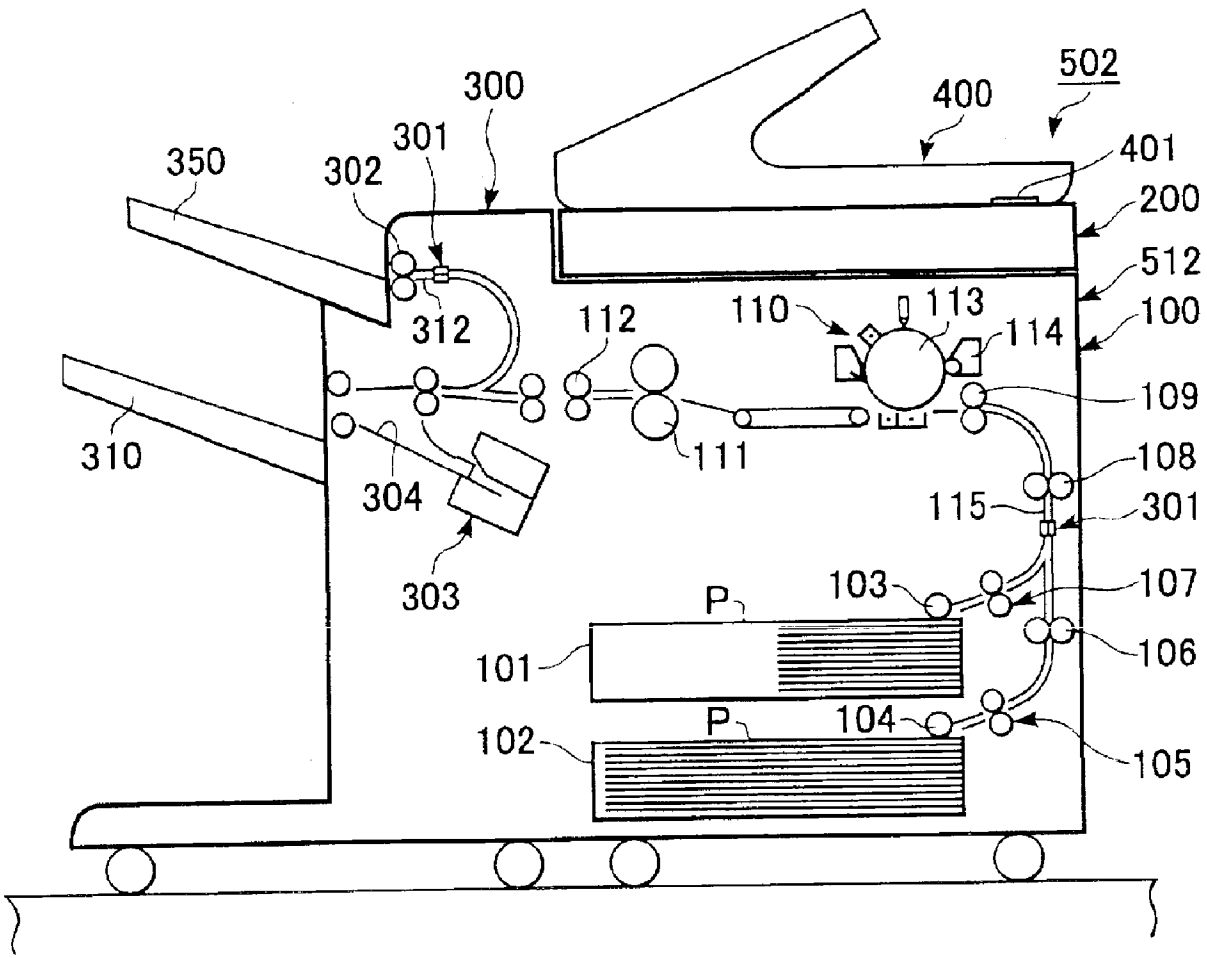
FIG. 9 is a sectional view of a copying machine sectioned along a recording-sheet feeding direction, the copying machine having a sheet-processing apparatus with a sheet-thickness detector device and a recording unit provided in a common machine body.
Figure 10:
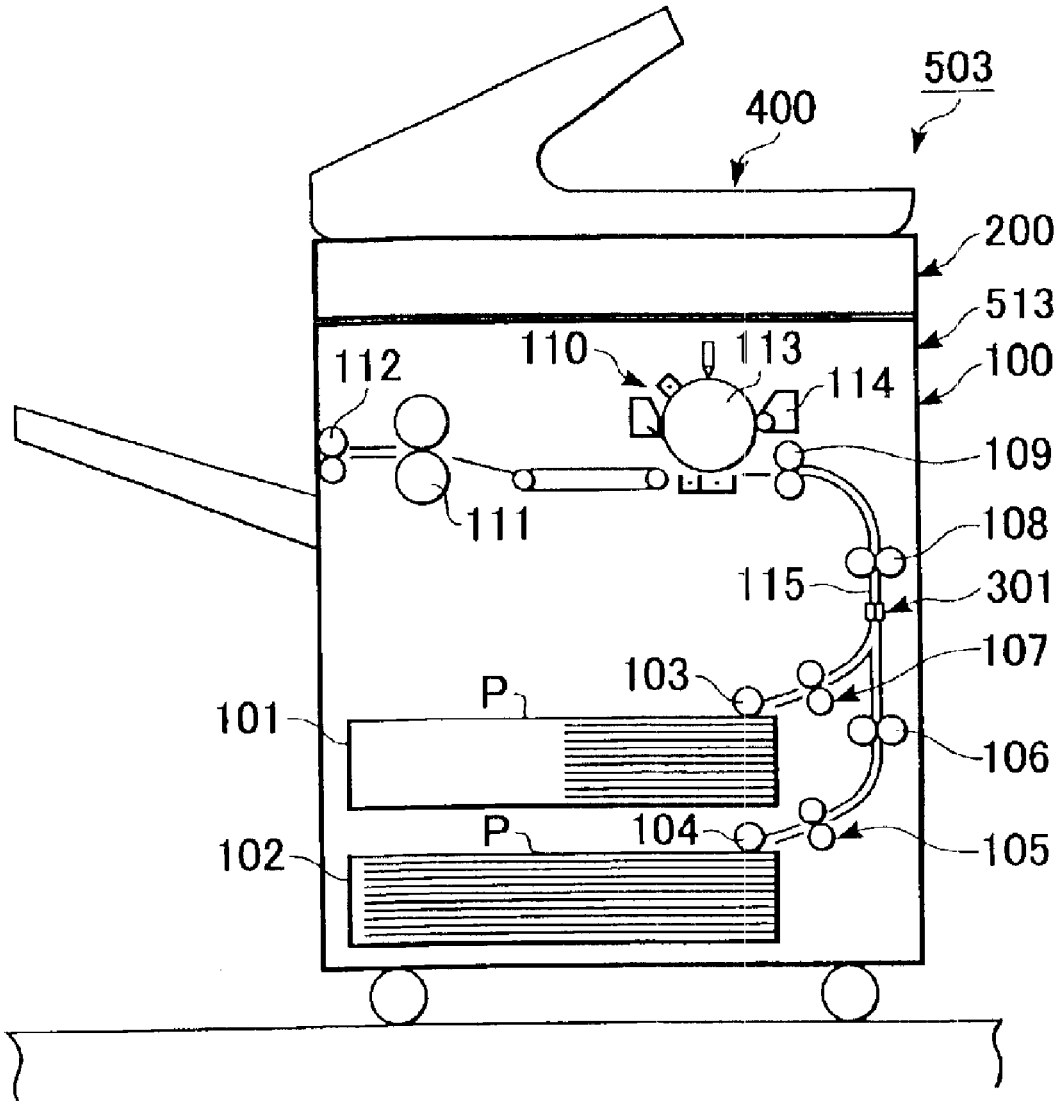
FIG. 10 is a sectional view of a copying machine having a sheet-thickness detector device sectioned along a recording-sheet feeding direction.
Figure 11:
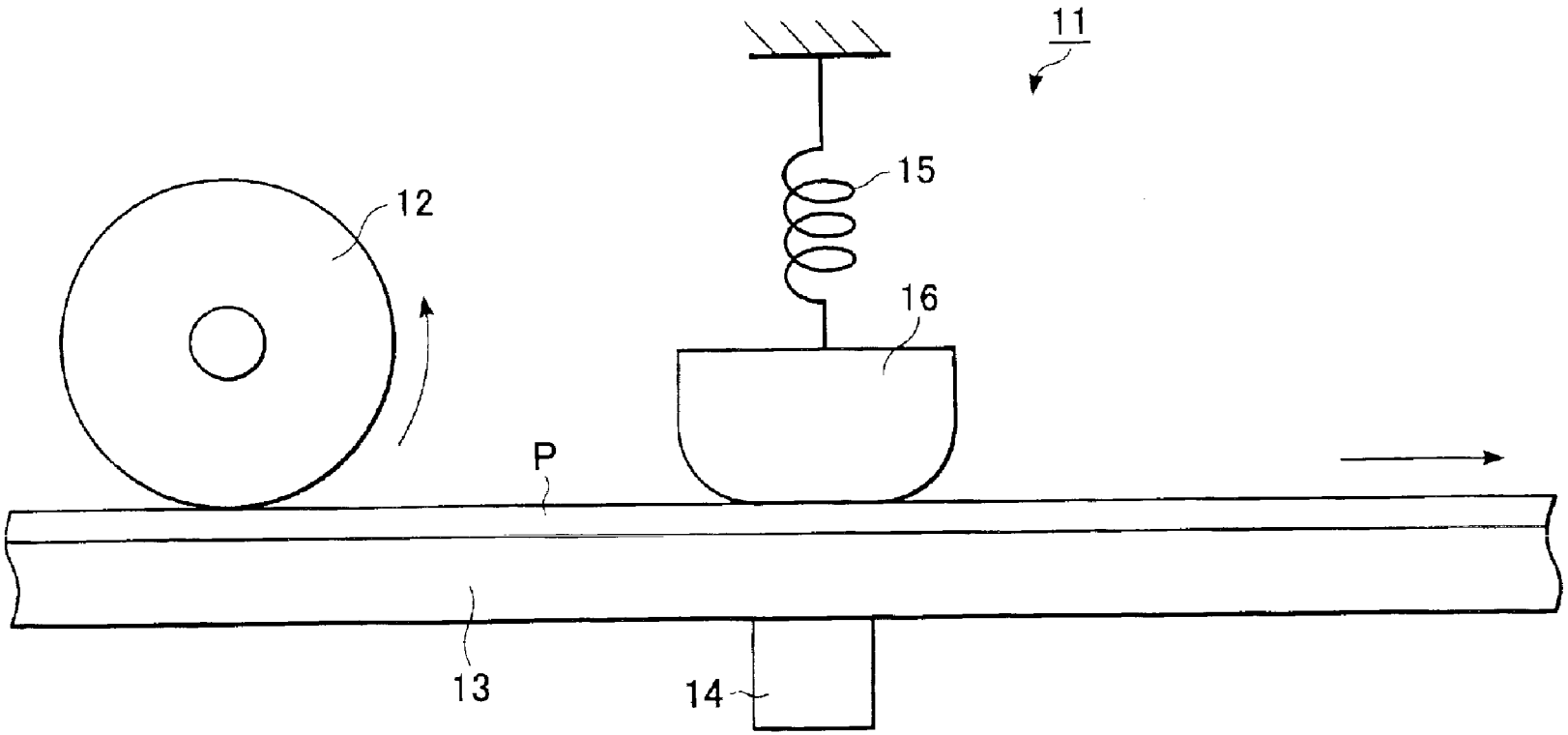
FIG. 11 PRIOR ART
FIG. 11 is a skeletal drawing of a conventional sheet-thickness detector device along an insert-sheet feeding direction.

The sheet-thickness detector device according to this embodiment is provided in a component of a copying machine, such as a post-processing unit 300 or an apparatus body 511 of a copying machine 501 shown in FIG. 1, an apparatus body 512 of a copying machine 502 shown in FIG. 9, or an apparatus body 513 of a copying machine 503 shown in FIG. 10.

The copying machine 502 shown in FIG. 9 has the same structure as the copying machine 501 shown in FIG. 1, and the copying machine 503 shown in FIG. 10 has the same structure as the copying machine 501 of apparatus body 511 shown in FIG. 1, so that like reference characters designate like elements common to the copying machine 501 shown FIG. 1, and the description thereof is omitted.

In an image-forming apparatus, there are a copying machine, a facsimile machine, a printer, and a compound machine combining these machines. A copying machine is exemplified in this embodiment; however, the present invention is not limited to the copying machine and may be any of the above machines.

A sheet-processing apparatus generally has at least one of the functions of lateral arrangement by jogging a sheet bundle, punching to perforate sheets, stapling (sewing) for binding sheets, and folding for folding a sheet. A sheet-processing apparatus according to this embodiment has the arrangement and the stapling functions in the above functions; alternatively other above functions may be provided by being not limited to the above two.

Also, the sheet-processing apparatus according to this embodiment, as in the copying machine 501 shown in FIG. 1, may be connected to the side of the apparatus body 511 as one of components or may be integrally assembled in the apparatus body 512 like in the copying machine 502 shown in FIG. 9.

FIG. 1 is a skeletal sectional view of the copying machine sectioned along the sheet feeding direction. The copying machine 501 comprises a document reader 200 for reading an original document, a document automatic feeder 400 for feeding the original document to the document reader 200, a recording unit (printer) 100 for forming an image on recording paper such as a sheet by an electrophotographic system based on the information read from the original document, and the post-processing unit (finisher) 300 for arranging and occasionally stapling plural recorded sheets as a sheet-processing apparatus. In addition, the document automatic feeder 400 is not necessarily required. Also, the post-processing unit 300 is not necessarily needed as in the copying machine 503 shown in FIG. 10.

Recording sheets P accommodated in cassettes 101 and 102 are fed therefrom to separating mechanisms 107 and 105 by feeding rollers 103 and 104, respectively, for conveying the recording sheet P one by one to an image-forming unit 110 after the sheet thickness is detected by a sheet-thickness detector device 301, which will be described later. The thickness of the recording sheet P is confirmed by the sheet-thickness detector device 301 along the way to the image-forming unit 110. If the sheet thickness is not a predetermined thickness, a determination is made that the recording sheet has been double-fed or is a different kind sheet and the sheet-thickness detector device 301 displays the abnormal state of the recording sheet P on a display 401 provided on the apparatus body 512.

The recording sheet P is conveyed by feed-roller pairs 106 and 108 so as to reach a register-roller pair 109. The recording sheet P is fed to image-forming unit 110 which may serve as image-forming means by adjusting timing after the skewing correction performed by the register-roller pair 109.

The image-forming unit 110 employs an electrophotographic system comprising a photosensitive drum 113 and a developing unit 114. The image-forming unit 110 forms images on a surface of a recording sheet P with toner based on an image-information signal fed from the document reader 200 or an output unit such as a computer (not shown). The recording sheet P having the toner images formed thereon reaches a fusing-roller pair 111 so as to pass through a nip between the fusing-roller pair 111. The fusing-roller pair 111 is heated by a heater (not shown). The toner images on the recording'sheet P are melted by the heat of the fusing-roller pair 111 so as to fuse on the surface of the recording sheet P as completed images.

The recording sheet P having toner images fused on the surface thereof by the fusing-roller pair 111 is discharged from the recording unit 100 by a discharge-roller pair 112 and conveyed to a sheet-processing apparatus such as the post-processing unit 300. In the post-processing unit 300, the recording sheets P are stored in an intermediate tray 304 and stacked in a bundle. When a predetermined number of the recording sheets P are stacked, the post-processing unit 300 staples the recording sheet bundle by a stapler 303 and then discharges the bundle onto discharge tray 310.

The recording sheet bundle can be elementally prepared by the post-processing unit 300 following the above procedure. Then, the case where an insert sheet PA prepared in advance is inserted into an arbitrary place of the recording sheet bundle using an interposing function will be described.

For inserting an insert sheet PA into the recording sheet bundle, the insert sheets PA prepared in advance are arranged in sequence and set on an insert tray 350 disposed on the upper part of the post-processing unit 300. When recording sheets P are stacked until the previous page of a predetermined insert place, the insert sheet PA set on the insert tray 350 is fed inside the post-processing unit 300 by a sheet-feed mechanism 302. Then, the insert sheet PA is laid on the recording sheet bundle stacked on the intermediate tray 304.

In such a manner, the insert sheets PA set on the insert tray 350 in a bundle are laid one by one on the sheet bundle in a desired place inputted in advance.

Here, for easily understanding this operation, a specific example will be exemplified. Three sheet bundles, each bundle being composed of A, b, C, d, E, and F, will be prepared. Each alphabetical character such as A, b, and C represents one sheet: wherein an uppercase represents a recording sheet having images to be recorded by the recording unit 100 and a lowercase represents an insert sheet prepared in advance to be inserted.

First, when using two kinds of the insert sheet b and d, three for each kind and six in total are prepared. Thus, an operator sets these six insert sheets on the insert tray 350 by sequentially laying them in the order of b, d, b, d, b, and d. Then, an instruction is inputted into the copying machine 501 that the insert sheet be inserted into the post-processing unit 300 at times corresponding to the second sheet and the fourth sheet. When the copying machine 501 is started, an image is recorded on the recording sheet A and sheet A is stacked on the intermediate tray 304 in the post-processing unit 300. Then, the printer 100 is not operated, and the insert sheet b is fed from the insert tray 350 and laid on top of the recording sheet A. Next, an image is recorded on the recording sheet C in the recording unit 100, and the recording sheet C is laid on top of the sheet bundle (A and b). In such a manner, the sheet bundle (A, b, C, d, E, and F) is finally prepared. The second and the third sheet bundle are prepared in the same way.

During the feeding of the insert sheets from the insert tray 350, if two or more insert sheets are double-fed, i.e., at the first feeding from the insert tray 350, the double feeding occurs in the above example, prepared bundles are (A, b, d, C, b, E, and F), (A, d, C, b, E, and F) and (A, d, C—), so that it is understood that not only the double-fed bundle but also all the bundles after the double feeding will be out of order. In such a manner, if the insert sheets are double fed from the insert tray 350, the operation becomes wasteful.

Then, the post-processing unit 300 according to this embodiment is provided with a sheet-thickness detector device 301 just after the insert tray 350. As a result, if the sheet-thickness detector device 301 detects double feeding of the insert sheet, the post-processing unit 300 stops the operation of the copying machine 501 immediately and displays the occurrence of double feeding in the post-processing unit 300 on the display 401, preventing the disordered sheet bundle from being prepared.

Figure 2:
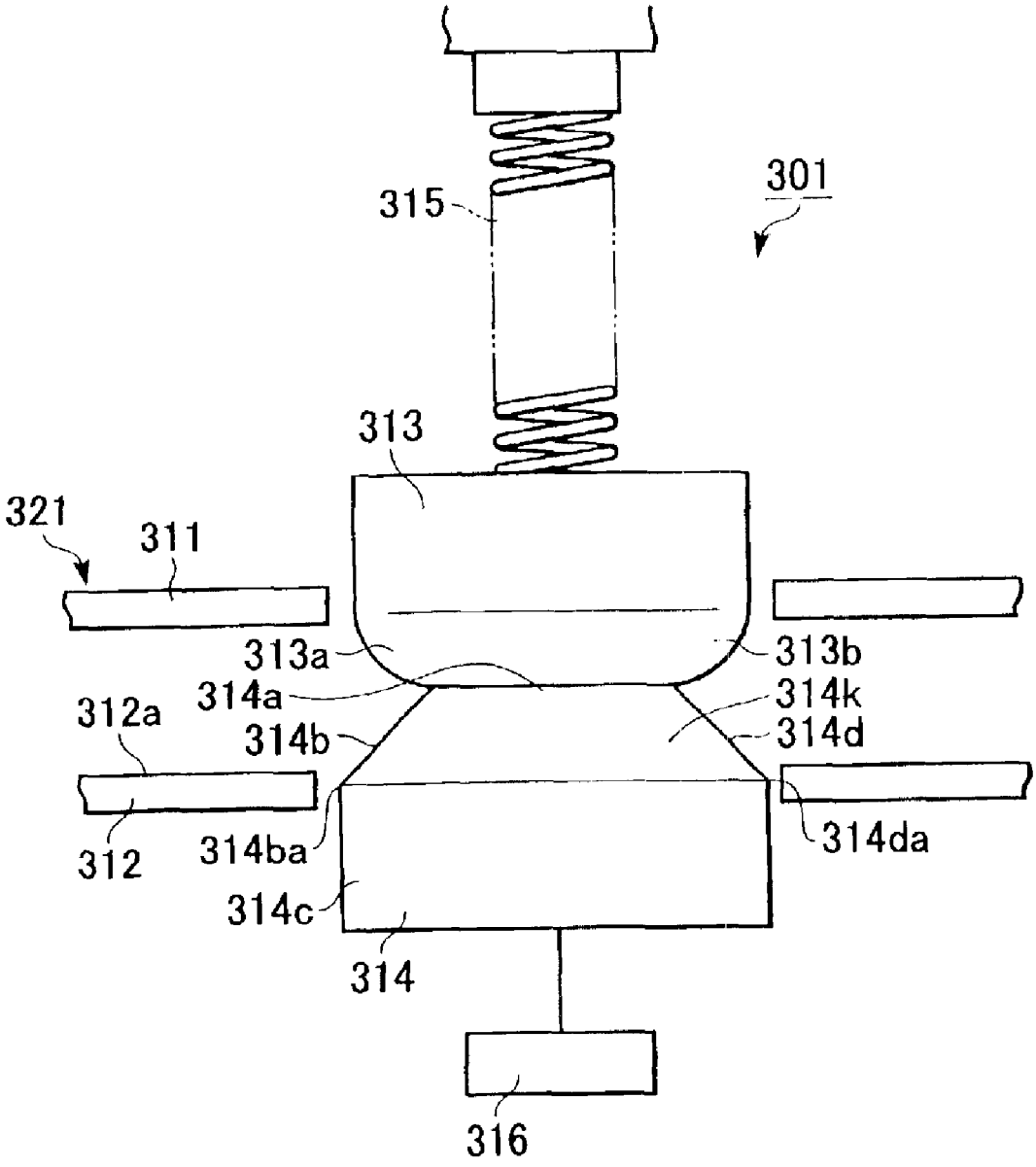
FIG. 2 is a skeletal drawing of the sheet-thickness detector device according to the embodiment of the present invention along an insert-sheet feeding direction.

FIG. 2 is a skeletal sectional view of the structure of sheet-thickness detector device 301. The sheet-thickness detector device 301 comprises a fixed magnetic field sensor 314, a magnetic element 313 which is a magnetic guide member urged toward the magnetic field sensor 314 by a pressurizing spring 315, and guide plates 311 and 312 for guiding a sheet such as an insert sheet PA between the magnetic field sensor 314 and the magnetic element 313, so that the thickness of the insert sheet PA fed along an insert-sheet guide surface 312*a* is detected by allowing the insert sheet PA to pass between the magnetic field sensor 314 and the magnetic element 313.

The guide plates 311 and 312 of the sheet-thickness detector device 301 are arranged in parallel at an interval so as to guide an insert sheet PA conveyed by a feed mechanism 302, constituting an insert-sheet conveying path 321. The magnetic field sensor 314 is fixed to the guide plate 312, which is one of the guide plates.

The magnetic element 313 is disposed at a position opposing the magnetic field sensor 314 and made of magnetized ferrite or neodymium. The magnetic element 313 is movably arranged in a direction perpendicular to the conveying path of the insert sheet PA, and generally urged towards the magnetic field sensor 314 by the pressurizing spring 315.

Figure 3:
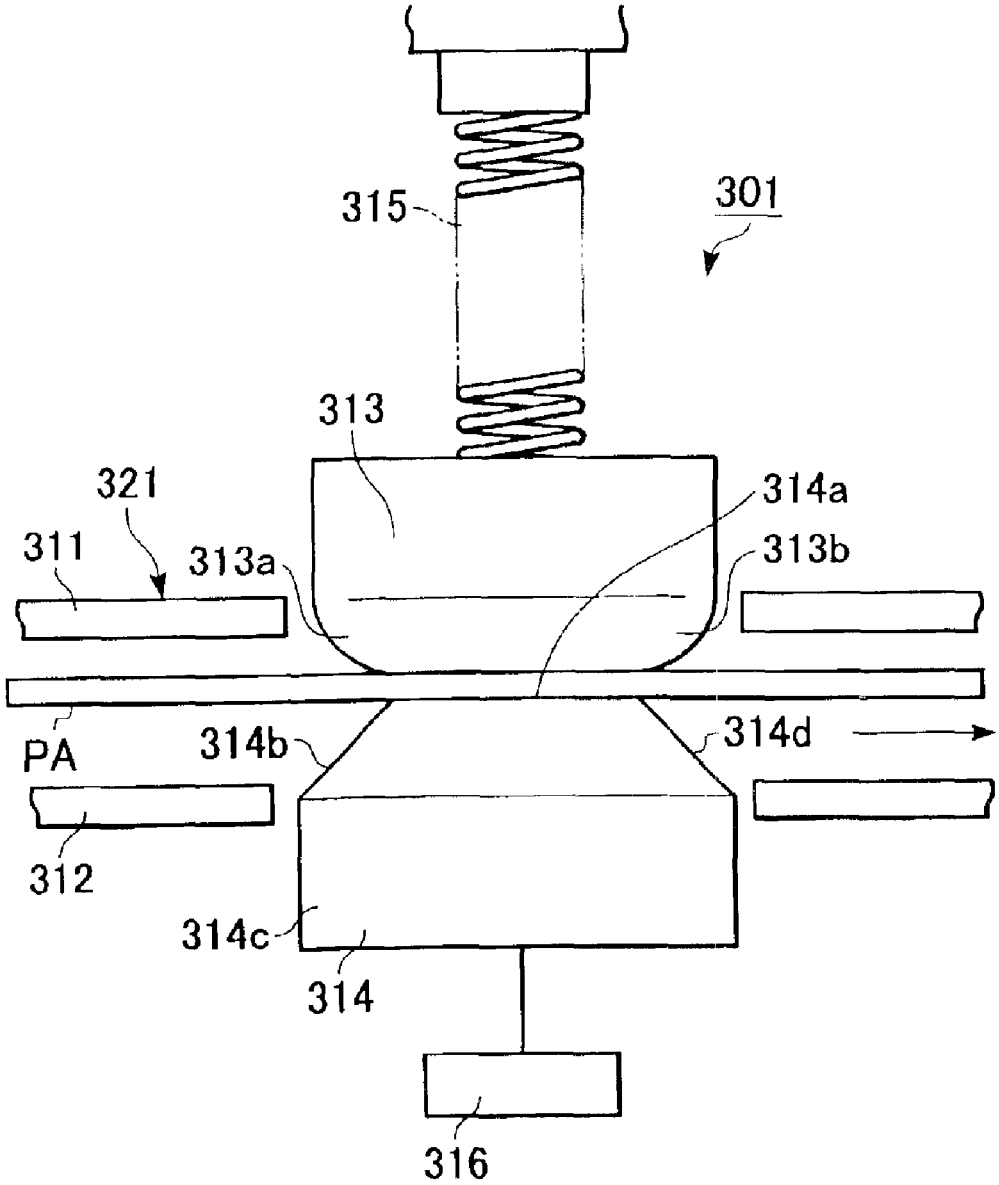
FIG. 3 is a drawing of the sheet-thickness detector device shown in FIG. 2 in a state of detecting the thickness of a sheet.

The insert sheet PA fed from the insert tray 350 reaches the sheet-thickness detector device 301. Upon receiving the insert sheet PA, the magnetic element 313 is raised by the insert sheet PA against an urging force of the pressurizing spring 315 so as to enter a floating state above the magnetic field sensor 314. The insert sheet PA is conveyed between the magnetic field sensor 314 and the magnetic element 313, and is sandwiched between the magnetic field sensor 314 and the magnetic element 313 of the sheet-thickness detector device 301 (see FIG. 3).

The change in distance between the magnetic field sensor 314 and the magnetic element 313 produces the change in intensity of magnetic field of the magnetic field sensor 314. The magnetic field sensor 314 detects the change in intensity of magnetic field so as to detect the distance between the magnetic field sensor 314 and the magnetic element 313, i.e., the thickness of the conveyed insert sheet PA. The output value of the magnetic field sensor 314 is sent to a control unit 316.

The detection of sheet thickness will now be described. The output of the magnetic field sensor 314 corresponding to the thickness of the insert sheet PA is first stored in the control unit 316. If the output value of the magnetic field sensor 314 when the insert sheet PA is practically conveyed is twice the stored value or more in integral multiples thereof, the control unit 316 determines that the insert sheet has been double-fed or the thickness be integral multiples of that of the insert sheet PA. Also, if the output value is different from the stored value, the control unit 316 determines that the detected insert sheet is a sheet with a different thickness.

If the thickness of the insert sheet PA is not constant using insert sheets with various thicknesses, the sheet-thickness detection can be performed more precisely by practically conveying these insert sheets so as to store the output values of the magnetic field sensor 314 in the control unit 316.

In order to detect the sheet thickness more precisely, it is preferable in using the sheet-thickness detector device 301 that the distance between the magnetic field sensor 314 and the magnetic element 313 be small so that the output value of the magnetic field sensor 314 is large. Then, according to this embodiment, in a state without the insert sheet PA, the magnetic field sensor 314 and the magnetic element 313 protrude from the guide plates 311 and 312, respectively, so that the magnetic element 313 abuts the magnetic field sensor 314 directly. Therefore, the insert sheet PA is directly sandwiched between the magnetic field sensor 314 and the magnetic element 313.

Because the magnetic field sensor 314 and the magnetic element 313 protrude into the path formed by guide plates 311 and 312, during conveying the insert sheet PA, there may be a problem that the insert sheet PA contacts and is held up by the magnetic field sensor 314 so as to produce a paper jam or damage the edges of the insert sheet PA.

Then, the sheet-thickness detector device 301 according to the embodiment comprises an approach-guide upward inclined plane 314*b* of the magnetic field sensor 314 disposed upstream of the conveying direction of the insert sheet PA for guiding the insert sheet PA to a detection surface 314*a* of a detection portion 314*k*. The approach-guide inclined plane 314*b* protrudes from the insert-sheet guide surface 312*a* in a state that a portion 314*ba* of the magnetic field sensor 314 nearer to a base portion 314*c* is within a width of the guide plate 312. The approach-guide inclined plane 314*b* is formed by cutting an edge line between the detection surface 314*a* and a side face of the magnetic field sensor 314 substantially perpendicular to the detection surface 314*a*.

In addition, the portion 314*ba* is not necessarily within a width of the guide plate 312 and it may protrude from the insert-sheet guide surface 312*a*.

The magnetic field sensor 314 also comprises a downward inclined surface 314*d* disposed downstream of the conveying direction of the insert sheet PA and inclining to the base portion 314*c* in a direction downstream of the conveying direction of the insert sheet PA for guiding the discharge of the insert sheet PA. The discharge-guide inclined plane 314*d* is formed by cutting an edge line between the detection surface 314*a* and a side face of the magnetic field sensor 314 substantially perpendicular to the detection surface 314*a*.

The discharge-guide inclined plane 314*d* protrudes from the insert-sheet guide surface 312*a* in a state that a portion 314*da* of the magnetic field sensor 314 nearer to the base portion 314*c* is within a width of the guide plate 312.

A conveyed insert sheet PA proceeds between the magnetic field sensor 314 and the magnetic element 313 guided by the upward inclined plane 314*b* without being caught on the magnetic field sensor 314, so that the thickness is detected.

The magnetic element 313 is provided with circular arc surfaces 313*a* and 313*b* formed upstream and downstream of the magnetic element 313, respectively, for guiding the insert sheet PA. Alternatively, each or both of the circular arc surfaces may be an inclined surface.

Therefore, since in the sheet-thickness detector device 301 according to this embodiment, the magnetic field sensor 314 directly comes into contact with the insert sheet PA so as to detect the thickness of the insert sheet PA, the distance between the magnetic element 313 and the magnetic field sensor 314 corresponds to the thickness of the insert sheet PA, which is smaller than in a conventional device, so that the precision in detecting the sheet thickness is improved, enabling the thickness of the insert sheet PA to be precisely detected. Also, with the sheet-thickness detector device 301 according to this embodiment, it is not necessary to detect the thickness of the insert sheet PA by interposing the guide plate 312 therebetween, so that the detection is not limited to the material of the guide plate 312.

Also, the sheet-thickness detector device 301 according to this embodiment is provided with the approach-guide inclined plane 314*b* disposed upstream of the magnetic field sensor 314, so that a conveyed insert sheet PA can be guided by the approach-guide upward inclined plane 314 so as to smoothly proceed between the magnetic field sensor 314 and the magnetic element 313 without being caught on the magnetic field sensor 314, enabling the thickness of the insert sheet PA to be precisely detected by avoiding jam factors of the insert sheet PA.

In the sheet-thickness detector device 301 according to this embodiment, since the leading edge of the insert sheet PA which has passed through the magnetic field sensor 314 is guided to the insert-sheet guide surface 312*a* by the discharge-guide inclined plane 314*d*, the insert sheet PA can be conveyed without hindrance. This design also keeps insert sheet PA from being caught on the magnetic field sensor 314, reducing the jam of the insert sheet PA. Moreover, if the magnetic field sensor 314 is turned by 180°, the discharge-guide inclined plane 314*d* becomes the approach-guide upward inclined plane 314*b* while the approach-guide upward inclined plane 314*b* becomes the discharge-guide inclined plane 314*d*, so that the magnetic field sensor 314 can be arranged without confirming the orientation of the magnetic field sensor 314, facilitating the assembling of the sheet-thickness detector device 301.

Figure 4:
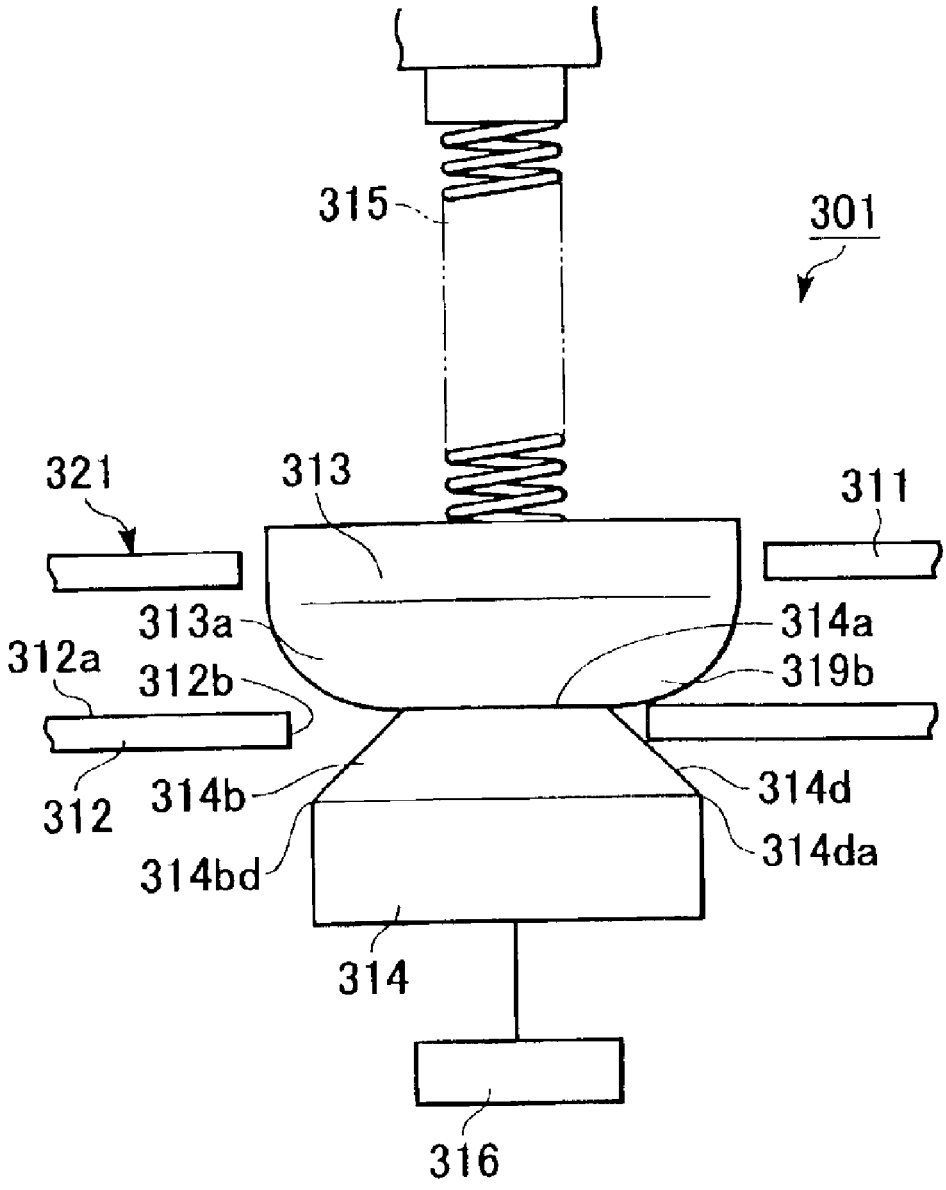
FIG. 4 is a skeletal drawing of a sheet-thickness detector device according to another embodiment of the present invention along an insert-sheet feeding direction.

As shown in FIG. 4, if the magnetic field sensor 314 is arranged so that the detection surface 314*a* contacting the magnetic element 313 is substantially flush with the insert-sheet guide surface 312*a*, the insert sheet PA need not climb over the magnetic field sensor 314 to pass therethrough. Therefore, because the sheet-thickness detector device 301 can allow the insert sheet PA to pass through leaving it flat as it is, the insert sheet PA can smoothly pass through the sheet-thickness detector device 301 while the thickness of the insert sheet PA can be absolutely detected in a flat state as it is. In addition, since the magnetic field sensor 314 is provided with the approach-guide inclined plane 314*b*, even if the edge of the insert sheet PA drops from an edge 312*b* of the guide plate 312, the insert sheet PA cannot jam.

Figure 5:
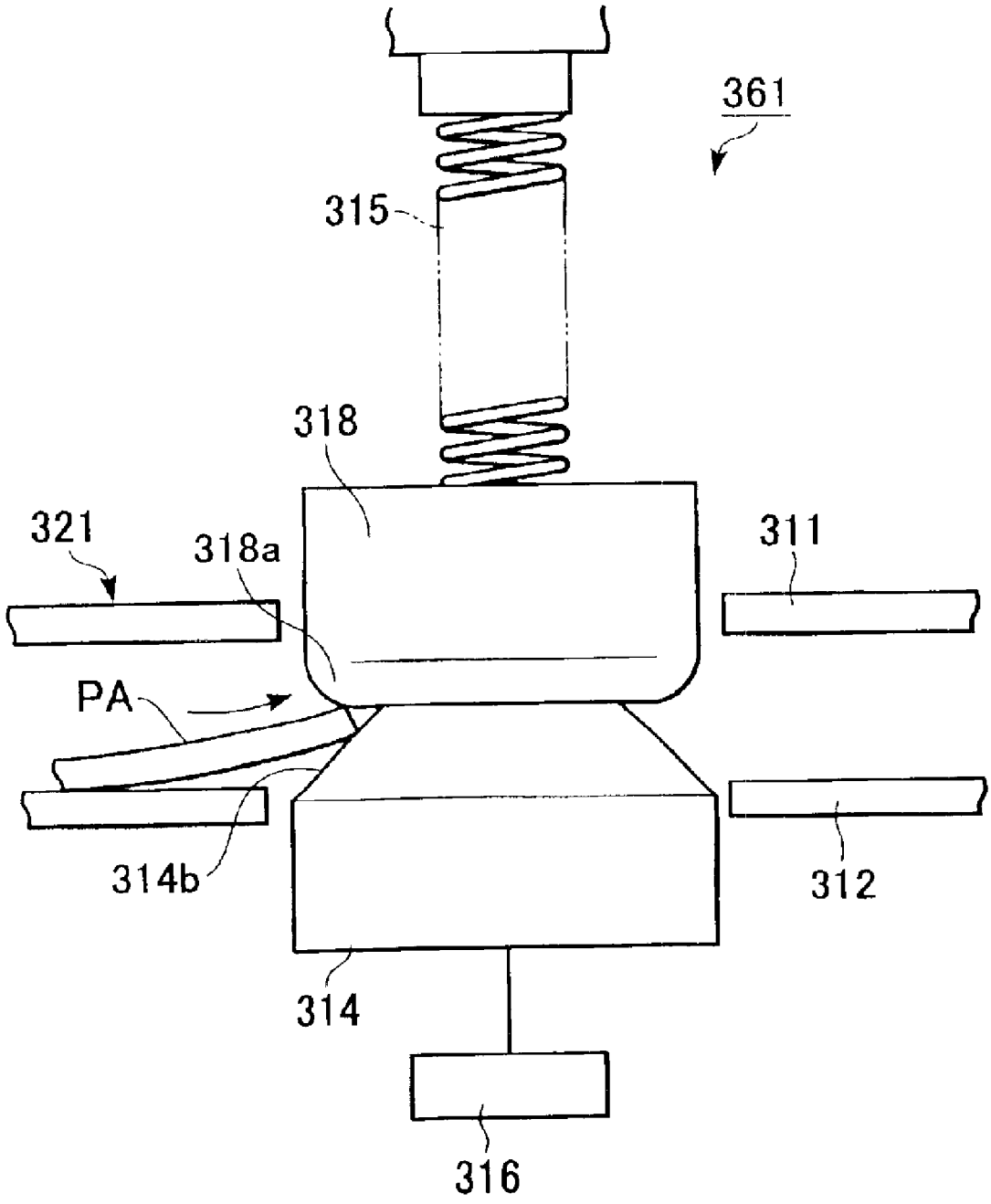
FIG. 5 is a skeletal drawing of a sheet-thickness detector device according to another embodiment of the present invention along an insert-sheet feeding direction.

The above magnetic element 313 does not protrude from the magnetic field sensor 314 in shape; however, like a magnetic element 318 shown in FIG. 5, it may protrude relative to the magnetic field sensor 314 in a direction upstream of the sheet-conveying direction. If there is such a protruded portion 318*a*, the magnetic element 318 receives an insert-sheet PA guided with the approach-guide inclined surface 314*b* at the protruded portion 318*a* so as to securely guide the insert-sheet PA through between the magnetic field sensor 314 and the magnetic element 318. Therefore, a sheet-thickness detector device 361 shown in FIG. 5 can reliably detect the thickness of the insert sheet PA without producing a jam of the insert sheet PA.

Figure 6:
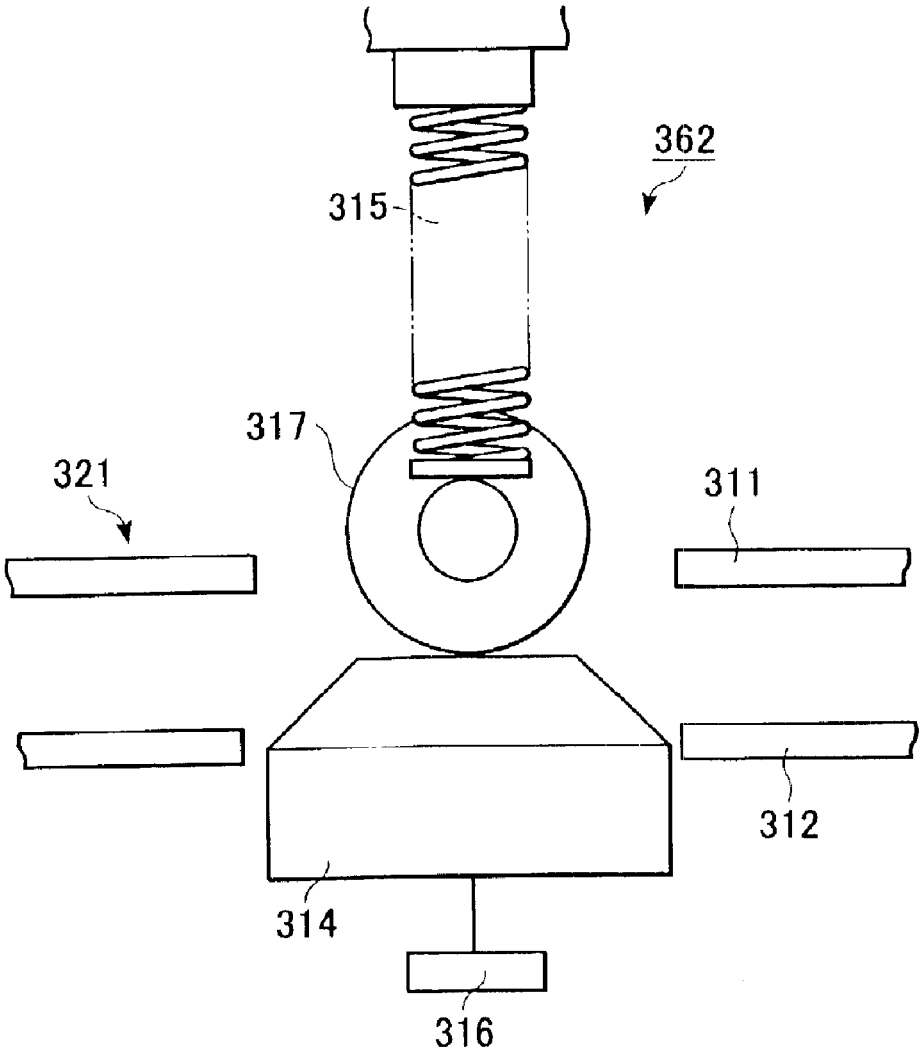
FIG. 6 is a skeletal drawing of a sheet-thickness detector device according to another embodiment of the present invention along an insert-sheet feeding direction.

A magnetic element, like a magnetic element 317 shown in FIG. 6, may be constructed in a roller-shape, in which a roller axis intersects with the insert-sheet conveying direction. Since the magnetic element 317 has line contact with an insert sheet PA, the contact area with the insert sheet PA is reduced, enabling the insert sheet PA to smoothly pass therethrough. If the magnetic element 317 is rotated following the passing of the insert sheet PA, the insert sheet PA is further enabled to smoothly pass therethrough. Therefore, a sheet-thickness detector device 362 shown in FIG. 6 can also reliably detect the thickness of the insert sheet PA without producing a jam of the insert sheet PA.

Figure 7:
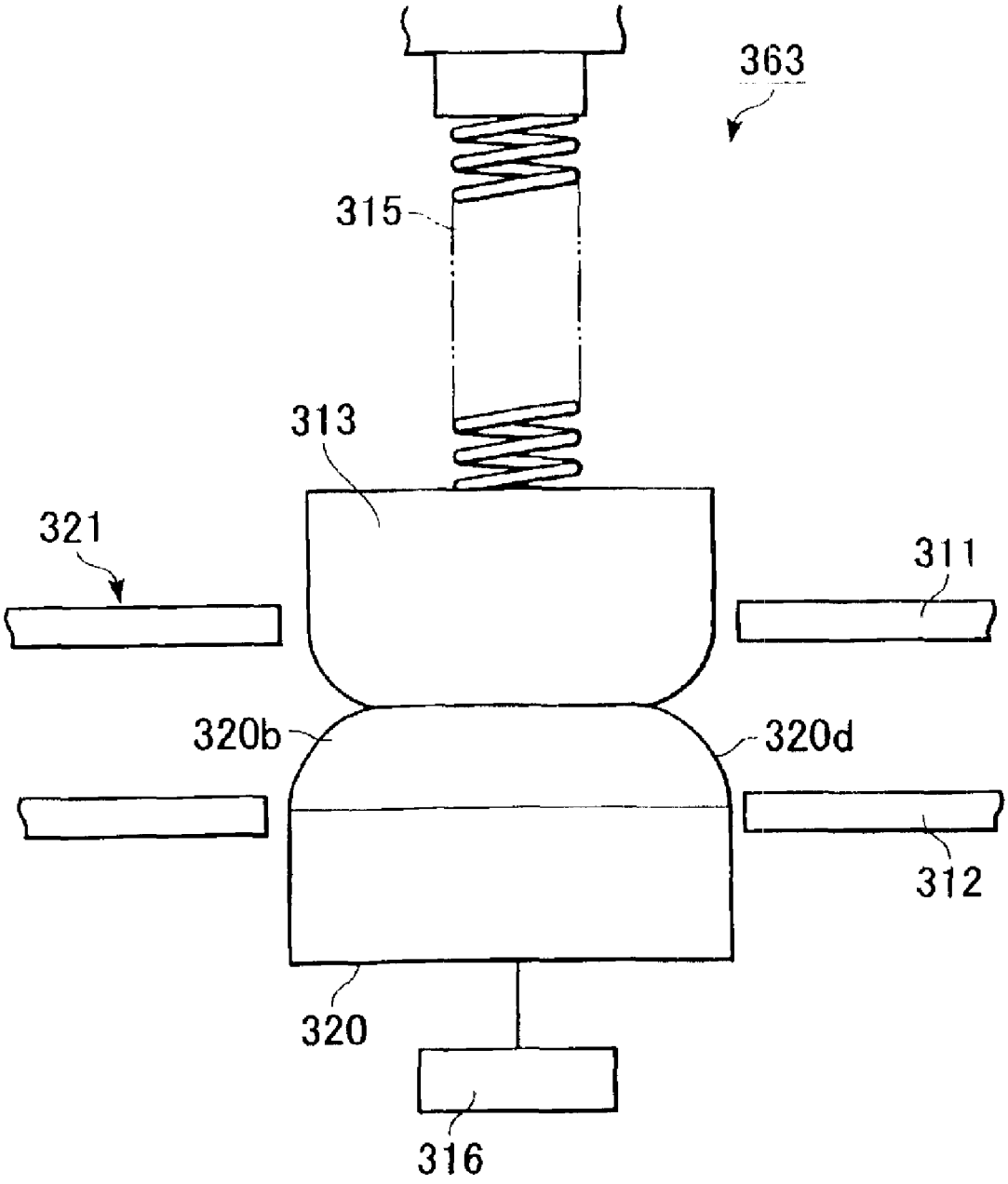
FIG. 7 is a skeletal drawing of a sheet-thickness detector device according to another embodiment of the present invention along an insert-sheet feeding direction.

The magnetic field sensor 314 described above comprises the approach-guide inclined plane 314*b* and the discharge-guide inclined plane 314*d* for guiding the insert sheet; alternatively, like a magnetic field sensor 320 shown in FIG. 7, it may have circular arc surfaces 320*b* and 320*d*. Therefore, a sheet-thickness detector device 363 shown in FIG. 7 can also reliably detect the thickness of the insert sheet PA without producing jam of the insert sheet PA.

Figure 8:
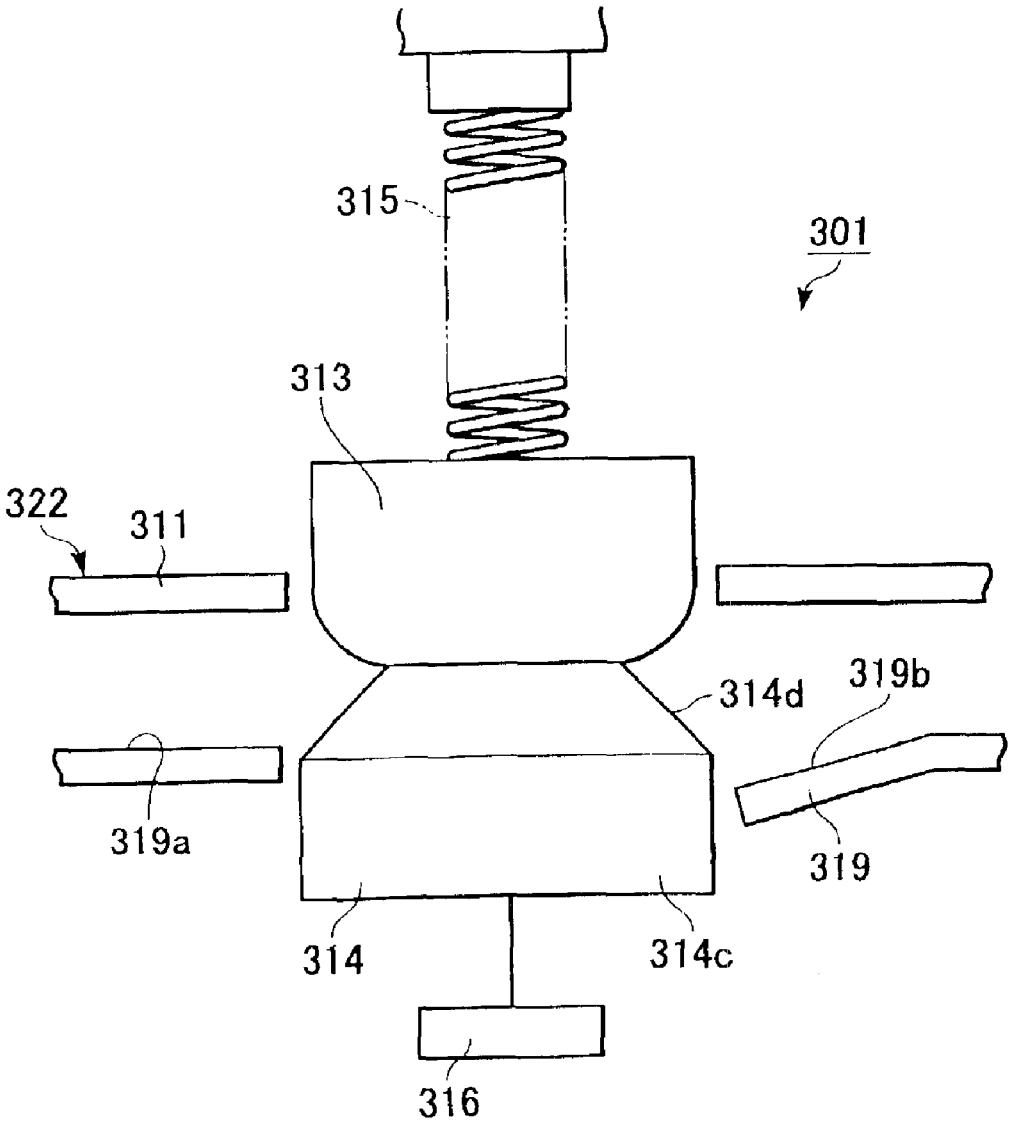
FIG. 8 is a drawing of the sheet-thickness detector device shown in FIG. 2 having a guide plate different in shape.

The sheet-thickness detector devices 301, 361, 362, and 363 according to the embodiments described above are assembled in the flat guide plates 311 and 312; alternatively, the magnetic field sensor 314 may be assembled in an insert-sheet conveying path 322 shown in FIG. 8. The insert-sheet conveying path 322 is provided with a guide plate 319, having an inclined plane 319*b* inclining downward toward base 314*c* of the magnetic field sensor 314 in a direction toward the magnetic field sensor 314, and a flat guide plate 311 opposing the guide plate 319. In this case, a discharge-guide inclined plane 314*d* protrudes from the inclined plane 319*b*.

An insert sheet conveyed along a sheet-guide surface 319*a* of the guide plate 319 is received and guided by the inclined plane 319*b* when passing through the magnetic field sensor 314, so that the insert sheet can be stably conveyed without being caught on the guide plate 319. This also enables the sheet-thickness detector device 301 to reliably detect a sheet thickness.

In addition, in the insert-sheet conveying path 322, the magnetic field sensor 320 shown in FIG. 7 may be assembled.

The sheet-thickness detector device 301 determines the double feeding of an insert sheet and the kind of the insert sheet, such as a determination of whether ordinary paper or a card board is detected, by detecting the thickness of the insert sheet supplied from the interposer in the post-processing unit 300; however, the device of course is not limited to such uses.

For example, as shown in FIG. 1, the sheet-thickness detector device 301 is assembled upstream of the image-forming unit 110, so that double feeding of a recording sheet P to the image-forming unit 110 can be prevented, as can use an incorrect and different kind sheet. Furthermore, the sheet-thickness detector device 301 may also be used to determine the kind of a recording sheet P (ordinary paper or a card board) by detecting the thickness of the recording sheet P so as to adjust image-forming process conditions such as a fusing temperature of the fusing roller pair 111.

The sheet-thickness detector devices 301, 361, 362, and 363 according to the embodiments shown in FIGS. 2 to 8 are mounted midstream of a horizontal insert-sheet conveying path 321 of the post-processing unit 300; alternatively, they may be arranged, as shown in FIG. 1, midstream of a vertical or inclined recording-sheet conveying path 115 located upstream of the image-forming unit 110.

In the sheet-thickness detector devices 301, 361, 362, and 363 according to the embodiments shown in FIGS. 2 to 8, the magnetic elements 313, 318, and 317 are arranged movably in a direction perpendicular to the conveying path, and by the pressurizing spring 315, the magnetic elements 313, 318, and 317 are urged toward the magnetic field sensors 314 and 320. However, the magnetic field sensors 314 and 320 may be arranged movably in a direction perpendicular to the conveying path, and by the pressurizing spring, the magnetic field sensor 314 may be urged toward the magnetic elements 313, 318, and 317.

In the sheet-thickness detector device according to the present invention, the thickness of a sheet is detected by bringing the magnetic field sensor having the approach-guide plane disposed upstream of the sheet conveying direction into direct contact with the sheet, so that the determination of the sheet double feeding and the desired sheet thickness can be precisely performed without inhibiting the conveying of a sheet, having the advantage of the stable sheet-conveying compatible with the accurate detection of the sheet-thickness.

The sheet-processing apparatus according to the present invention has the sheet-thickness detector device for detecting the sheet double-feeding and the different thickness of a sheet, so that processing of the double-fed sheet and the different-thickness sheet can be eliminated, having the advantage of not wasting away the double-fed sheet and the different-thickness sheet.

The sheet-processing apparatus according to the present invention has the sheet-thickness detector device for detecting the sheet double-feeding and the different thickness of a sheet, so that the advantage is obtained in that forming images on the double-fed sheet and the different-thickness sheet can be eliminated by detecting them with the sheet-thickness detector device.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. A sheet-thickness detector device comprising:

a sheet-guide member for guiding a sheet;

a magnetic field sensor directly contactable with a sheet guided by said sheet-guide member;

a magnetic guide element that is urged toward said magnetic field sensor; and a control unit adapted to receive output from said magnetic field sensor and determine sheet thickness based thereon, wherein the thickness of a sheet is detected by allowing the sheet guided by the sheet-guide member to pass between said magnetic field sensor and said magnetic guide element, and wherein said magnetic field sensor comprises an approach-guide plane disposed on an upstream side in a sheet-conveying direction for guiding a sheet to a position between said magnetic guide element and said magnetic field sensor.

2. A device according to claim 1, wherein said magnetic field sensor is comprises of a base portion and detection portion having said approach-guide plane, and wherein the approach-guide plane of said magnetic field sensor inclines toward the base portion of said magnetic field sensor as it extends in an upstream direction.

3. A device according to claim 2, wherein the detection portion further comprises a discharge-guide plane that is disposed on a downstream side in the sheet-conveying direction and inclined toward the base portion of said magnetic field sensor as it extends in a downstream direction.

4. A device according to claim 1, wherein said sheet-guide member has a sheet-guide surface for guiding a sheet, wherein said magnetic field sensor is comprised of a base portion and a detection portion having said approach-guide plane, and wherein the approach-guide plane of said detection portion protrudes from the sheet-guide surface in a state that a portion of the approach-guide plane nearer to the base portion is within a width of the sheet-guide member.

5. A device according to claim 1, wherein said sheet-guide member has a sheet guide surface for guiding a sheet, and wherein a surface of the detection portion of said magnetic field sensor contacting the magnetic guide element is substantially flush with the sheet-guide surface.

6. A device according to claim 1, wherein said magnetic guide element is a roller wherein an axis of the roller is perpendicular to the insert-sheet conveying direction.

7. A device according to claim 1, wherein the approach-guide plane is an inclined plane.

8. A device according to claim 1, wherein the approach-guide plane is a circular arc.

9. A device according to claim 1, further comprising a pressurizing spring positioned for urging said magnetic guide element toward said magnetic field sensor, wherein a sheet guided along the approach-guide plane of said magnetic field sensor contacts said magnetic guide element and resists the urging force of the pressurizing spring, and wherein the magnetic field sensor detects an intensity of a magnetic field corresponding to a distance between said magnetic guide element and the magnetic field sensor.

10. A device according to claim 1, further comprising a downstream side sheet-guide member located downstream of the magnetic field sensor for guiding a sheet;

wherein said magnetic field sensor is comprised of a base portion and a detection portion having said approach-guide plane, and wherein the downstream side sheet-guide member comprises an inclined plane which inclines toward the base portion of the magnetic field sensor as it extends in an upstream direction.

11. A device according to claim 1, wherein said sheet-guide member has a sheet-guide surface for guiding a sheet, wherein the approach-guide plane protrudes from the sheet-guide surface toward said magnetic guide element.

12. A device according to claim 1, wherein said sheet-guide member has a sheet-guide surface for guiding a sheet, wherein said magnetic field sensor is comprised of a base portion and a detection portion having said approach-guide plane, and wherein the approach-guide plane of said detection portion protrudes from the sheet-guide surface toward said magnetic guide element in a state that a portion of the approach-guide plane nearer to the base portion is on an opposite side of said magnetic guide element from said sheet-guide surface.

13. A sheet-processing apparatus comprising:

a sheet-guide member for guiding a sheet;

a magnetic field sensor directly contactable with a sheet guided by said sheet-guide member;

a magnetic guide element that is urged toward said magnetic field sensor, wherein said magnetic field sensor comprises an approach-guide plane disposed on an upstream side in a sheet-conveying direction for guiding a sheet to a position between the magnetic guide element and the magnetic field sensor;

a control unit adapted to receive output from said magnetic sensor and determine sheet thickness based thereon; and sheet-processing means for performing processing on a sheet after the thickness of the sheet has been detected by sheet passage between said magnetic field sensor and said magnetic guide clement.

14. An apparatus according to claim 13, further comprising a downstream side sheet-guide member located downstream of the magnetic field sensor for guiding a sheet, wherein said magnetic field sensor is comprised of a base portion and a detection portion having said approach-guide plane, and wherein the downstream side sheet-guide member comprises an inclined plane inclining toward the base portion of said magnetic field sensor as it extends in an upstream direction.

15. An apparatus according to claim 13, wherein said sheet-guide member has a sheet-guide surface for guiding a sheet, and wherein said magnetic field sensor is comprised of a base portion and a detection portion having said approach-guide plane, wherein the approach-guide plane of said magnetic field sensor protrudes from the sheet-guide surface in a state that a portion of the approach-guide plane nearer to the base portion is within a width of the sheet-guide member.

16. An apparatus according to claim 13, wherein said magnetic field sensor is comprised of a base portion and a detection portion having said approach-guide plane, wherein the approach-guide plane of said magnetic field sensor inclines toward the base portion of said magnetic field sensor as it extends in an upstream direction.

17. An apparatus according to claim 13, wherein said sheet-guide member has a sheet-guide surface for guiding a sheet, wherein said magnetic field sensor is comprised of a base portion an a detection portion having said approach-guide plane, and wherein the approach-guide plane of said detection portion protrudes from the sheet-guide surface toward said magnetic guide element in a state that a portion of the approach-guide plane nearer to the base portion is in a opposite side of said magnetic guide element from said sheet-guide surface.

18. An image-forming apparatus comprising:

a sheet-guide member for guiding a sheet;

a magnetic field sensor directly contactable with a sheet guided by the sheet-guide member;

a magnetic guide element that is urged toward said magnetic field sensor, wherein said magnetic field sensor, comprises an approach-guide plane disposed on an upstream side in a sheet-conveying direction for guiding a sheet to a position between said magnetic guide element and said magnetic field sensor;

a control unit adapted to receive output from said magnetic field sensor and determine sheet thickness based thereon; and image forming means for forming images on a sheet after the sheet thickness has been detected by sheet passage between the magnetic field sensor and the magnetic guide element.

19. An apparatus according to claim 18, further comprising a downstream side sheet-guide member located downstream of the magnetic field sensor for guiding a sheet, wherein said magnetic field sensor has a base portion and a detection portion having said approach-guide plane, and wherein the downstream side sheet-guide member comprises an inclined plane inclining downstream toward the base portion of said magnetic field sensor as it extends in an upstream direction.

20. An apparatus according to claim 18, wherein said sheet-guide member has a sheet-guide surface for guiding a sheet, wherein said magnetic field sensor is comprised of a base portion and a detection portion having said approach-guide plane, and wherein the approach-guide plane of said magnetic field sensor protrudes from the sheet-guide surface in a state that a portion of the approach-guide plane nearer to the base portion is within a width of the sheet-guide member.

21. A sheet-thickness detector device comprising:

a magnetic field sensor directly contactable with a sheet;

a magnetic guide element; and a pressurizing spring for urging one of said magnetic field sensor and said magnetic guide element toward the other, wherein a thickness of the sheet is detected when the sheet passes between said magnetic field sensor and said magnetic guide element, and wherein one of said magnetic field sensor and said magnetic guide element has an approach-guide plane disposed on an upstream side in a sheet-conveying direction for guiding the sheet to a position where the sheet is between said magnetic guide element and said magnetic field sensor.

22. A device according to claim 21, further comprising a sheet-guide member having a sheet-guide surface for guiding the sheet passing between said magnetic field sensor and said magnetic guide element, wherein the approach-guide plane provided in one of said magnetic field sensor and said magnetic guide element extends from the sheet-guide surface to a surface of one of said magnetic field sensor and said magnetic guide element in contact with the other, wherein as a sheet guided with the approach-guide plane enters between said magnetic field sensor and said magnetic guide element, the sheet urges one of said magnetic guide element and the magnetic field sensor against an urging force of the pressurizing spring, and wherein the magnetic field sensor detects intensity of magnetic field corresponding to a distance between said magnetic guide element and said magnetic field sensor.

* * * * *

UNITED STATES PATENT AND TRADEMARK OFFICE

CERTIFICATE OF CORRECTION

PATENT NO. : 6,871,042 B2
DATED : March 22, 2005
INVENTOR(S) : Masaharu Nemura et al.

It is certified that error appears in the above-identified patent and that said Letters Patent is hereby corrected as shown below:

Title page,
Item [56], References Cited, FOREIGN PATENT DOCUMENTS,
"05301657 A" should read -- 05-301657 A --.

Column 4,
Line 14, "kind" should read -- kind of --.
Line 34, "recording´" should read -- recording --.

Column 9,
Line 15, "kind" should read -- kind of --.

Column 10,
Line 25, "comprises" should read -- comprised --.

Column 11,
Line 17, "sheet," should read -- sheet, and --.
Line 63, "sheet, and" should read -- sheet, --.
Line 67, "plane," should read -- plane, and --.

Column 12,
Line 9, "plane," should read -- plane, and --.
Line 17, "an a" should read -- and a --.
Line 22, "in a" should read -- in an --.

Signed and Sealed this

Ninth Day of August, 2005

JON W. DUDAS
*Director of the United States Patent and Trademark Office*